United States Patent [19]

Shwartzman

[11] Patent Number: 4,727,611

[45] Date of Patent: Mar. 1, 1988

[54] APPARATUS AND METHOD FOR DYEING YARNS

[75] Inventor: Lior Shwartzman, Ramat Gan, Israel

[73] Assignee: Arel Technology (1971) Ltd., Yavne, Israel

[21] Appl. No.: 886,430

[22] Filed: Jul. 17, 1986

[30] Foreign Application Priority Data

Aug. 6, 1985 [IL] Israel ..... 76022

[51] Int. Cl.[4] ..... D06B 5/16

[52] U.S. Cl. ..... 8/155.1; 68/189

[58] Field of Search ..... 8/155.1, 158; 68/189, 68/198

[56] References Cited

U.S. PATENT DOCUMENTS

| | | | |
|---|---|---|---|
| 3,581,528 | 6/1971 | Mortensen | 68/189 |
| 3,620,234 | 11/1971 | Everroad | 68/189 X |
| 3,631,691 | 1/1972 | Karrer | 68/189 X |
| 3,638,458 | 2/1972 | Libbrecht | 68/189 |
| 3,751,946 | 8/1973 | Claiborne | 68/189 X |
| 3,760,614 | 9/1973 | Bergholtz | 68/189 |
| 4,086,688 | 5/1978 | Dombrowski | 8/154 X |
| 4,097,232 | 6/1978 | Negola et al. | 8/155.1 X |
| 4,206,619 | 6/1980 | Fukuroi et al. | 68/189 X |
| 4,306,251 | 11/1981 | Santens et al. | 68/189 |
| 4,321,808 | 3/1982 | Hull | 68/198 X |

FOREIGN PATENT DOCUMENTS

| | | | |
|---|---|---|---|
| 2444741 | 8/1980 | France | 68/189 |
| 931855 | 5/1982 | U.S.S.R. | 68/189 |

*Primary Examiner*—Harvey C. Hornsby
*Assistant Examiner*—Frankie L. Stinson
*Attorney, Agent, or Firm*—Cushman, Darby & Cushman

[57] ABSTRACT

Apparatus for dyeing yarn of the type wherein yarn is wound on cones mounted on a carrier in a vessel fitted with inlet and outlet conduits for the dye liquor, whereby the latter may be circulated in two modes, namely, in a first mode from the inside of the cones, and therethrough to the outside; and in a second mode vice-versa, and including means for operating in the first mode such that the amount of circulating dye liquor is little more than just sufficient to fill the inside of the cones and the perforate carrier, thus leaving the major part of the vessel space outside the volume occupied by the cones and the perforate carrier substantially free of dye liquor.

7 Claims, 2 Drawing Figures

APPARATUS AND METHOD FOR DYEING YARNS

FIELD OF THE INVENTION

The present invention relates to an apparatus and method for dyeing yarns, whereby the yarns are wound on cones mounted on a perforate carrier.

BACKGROUND OF THE INVENTION

It is known to use an apparatus for dyeing yarn of the type wherein yarn is wound on cones mounted on a perforate carrier in a vessel fitted with inlet and outlet conduits for the dye liquor, whereby the latter may be circulated in two modes, namely, in a first mode from the inside of the cones, and therethrough to the outside, and in a second mode vice-versa, that is to say from the outside of the cones and therethrough to the inside. In this known operation, ancillary systems may be present including an expression tank, a dyestuff liquor preparation tank, a heat exchanger and a control system.

Whether the dyestuff liquor is flowing in the first mode or in the second mode, the dyeing vessel is full of liquor, and the ratio of liquor to yarn may be approximately 8 liters liquor: 1 kg. yarn. The liquor flow may be approximately 20–40 liters/minute/kg. yarn in each direction.

It is known that in this type of operation, the dyeing time depends on the number of reversals of circulation of the dyeing liquor through the cones of yarn, and not merely on the residence time of the yarn in the vessel. It would therefore be advantageous to increase the back-and-fourth flow rate, so as to shorten the dyeing time. The obvious way to achieve such an object would be to increase the capacity of the pump(s) and piping. This method however is very expensive, because apart from the increased cost of the new and increased-capacity installation, the increased flow has to overcome increased suction, which increases in a squared relationship. This obvious method is therefore uneconomical.

SUMMARY OF THE INVENTION

In accordance with the present invention, apparatus has been developed which enables rapid dyeing to be achieved at an economical cost because of savings in chemicals and energy. The part of the dyeing cycle in which the dye liquor flows from inside the cones to outside is achieved using a substantially reduced amount of dye liquor. Thus, there is overall a lower ratio of liquor to yarn than in the prior art, there is less liquid to be circulated, and consequently expensive pumps of huge capacity are not required.

There is thus provided in accordance with the invention an apparatus for dyeing yarn of the type wherein yarn is wound on cones mounted on a carrier in a vessel fitted with inlet and outlet conduits for the dye liquor, whereby the latter may be circulated in two modes, namely, in a first mode from the inside of the cones, and therethrough to the outside; and in a second mode vice-versa, and including means for operating in the first mode such that the amount of circulating dye liquor is little more than just sufficient to fill the inside of the cones and the perforate carrier, thus leaving the major part of the vessel space outside the volume occupied by the cones and the perforate carrier substantially free of dye liquor. In one embodiment of the invention, the means for operating in the first mode includes outlet conduit means situated near the base of the vessel.

Preferably, the apparatus comprises also gas inlet conduit means situated near the top of the vessel whereby the dyeing process may be operated under pressure, as well as pump means for circulating dye liquor and valve means for circulating dye liquor alternately in the two modes. Preferably also, the apparatus includes heat exchange means.

In one embodiment, the apparatus also includes means for supplying fresh dye liquor from the system.

It will evidently be advantageous for the apparatus to comprise also a control system for controlling the alternate operation in said two modes including when desired the control of fresh dye liquor supply to the system and/or of spent dye liquor removal from the system and/or the flow of dye liquor to or from a reserve tank.

The invention further provides a method for dyeing yarn which comprises operating in alternate modes as described above and utilizing the apparatus described in the foregoing paragraphs. In one aspect, this method may be carried out using a single dyeing vessel.

The modes may be alternated, for example, at substantially regular intervals in the range of about 2 to about 5 minutes.

In another aspect, the method of the invention may be carried out using two dyeing vessels whereby a first vessel is operated in said first mode while simultaneously a second vessel is operated in said second mode and the operation is periodically switched so that the first vessel is operated in said second mode while the second vessel is operated in said first mode.

This switching may be effected, for example, at substantially regular intervals in the range of about 2 to about 5 minutes.

For the purpose of putting into effect the method of the invention just described, there is also provided in accordance with a further aspect of the invention, apparatus comprising two vessels as described above, and adapted so that a first vessel may be operated in said first mode while simultaneously a second vessel may be operated in said second mode and the operation may be periodically switched so that the first vessel may be operated in said second mode while the second vessel may be operated in said first mode. Preferably, the means for operating in the first mode includes outlet conduit means situated near the base of each vessel. Preferably also, the apparatus comprises gas inlet conduit means situated near the top of each vessel whereby the dyeing process may be operated under pressure. It will evidently be advantageous to use pump means for circulating dye liquor and valve means for circulating dye liquor alternately in said two modes, as well as heat exchange means.

In accordance with this further aspect of the invention, the apparatus comprises also means for supplying fresh dye liquor from a reservoir to the system and means for removing spent dye liquor from the system, and also a control system for controlling the alternate operation in said two modes including when desired the control of fresh dye liquor supply to the system and/or of spent dye liquor removal from the system and/or the flow of dye liquor to or from a reserve tank.

BRIEF DESCRIPTION OF THE DRAWINGS

The present invention will be understood and appeciated more fully from the following detailed description taken in conjunction with the drawings in which.

DETAILED DESCRIPTION OF THE INVENTION

Figure 1:
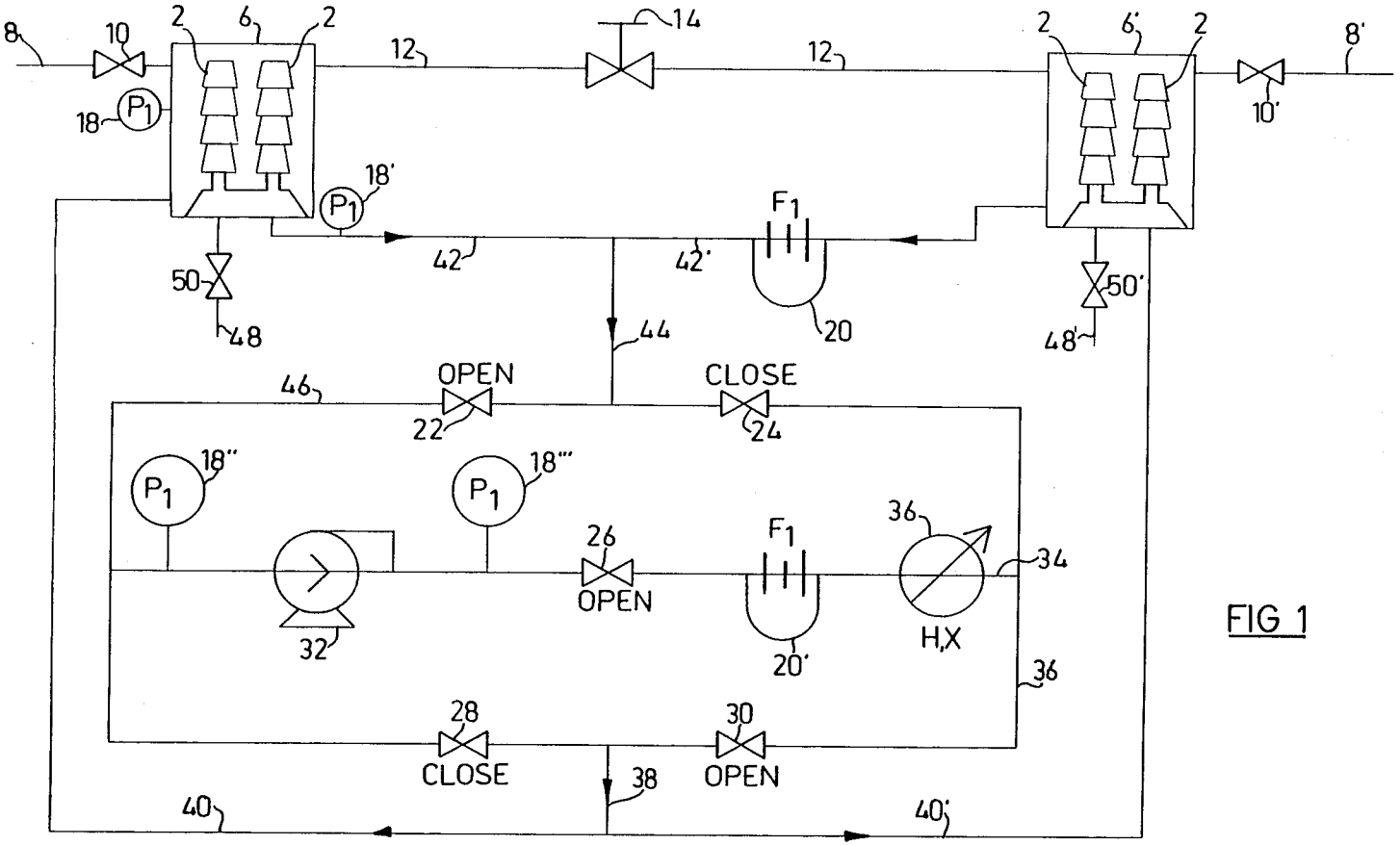
FIG. 1 illustrates the embodiment of the invention in which two vessels are used, of which one operates in one mode while the other operates simultaneously in the other mode.

Referring now to FIG. 1, it is seen that two vessels 6,6' each contain a plurality of stacked cones 2 of yarn and are operated under pressure by means of air conduits 8, 8' incorporating valves 10, 10'; the vessels are in this regard joined by air conduit 12 which incorporates valve 14.

At various points in the system there are located, for monitoring purposes, pressure gauges 18, 18', 18" and 18"' and liquid flowmeters 20, 20'. As illustrated, the figure shows that vessel 6' is being operated in the first mode (dye liquor circulation from inside through the cones to the outside) while simultaneously vessel 6 is being operated in the second mode (dye liquor circulation from outside through the cones to the inside).

In this condition of the liquid circulation valves, 22, 26 and 30 are open, and 24 and 28 are closed. Pump 32, or a plurality of such pumps, in any event circulates the dye liquor from left to right along conduit 34, via heat exchanger 36, whereby the liquor is heated. The liquor then passes via conduits 38, 40 and 40', as shown by the direction of the arrows, to vessels 6 and 6' respectively, and recirculates via conduits 42, 42', 44 and 46, to pump 32. Each vessel is additionally fitted with drain conduits 48, 48', incorporating respectively valves 50, 50'. Fresh dye liquor may be supplied to pump 32 by supply conduits (not shown). Spent dye liquor may be removed either by conduits 48, 48', or by other conduits (not shown). When it is desired to switch vessel 6' to the second mode and vessel 6 to the first mode, valves 22 and 30 are closed, and valves 24 and 28 are opened. It will be observed that the liquid will now circulate in a direction the reverse of that indicated by the arrows. The switching is preferably operated automatically at an interval lying within the range of about 2 to about 5 minutes, by control means (not shown).

In this aspect of the invention, in which two vessels are operated simultaneously in different modes, the vessels are shown spaced apart. However, any equivalent manner of operation may be effected, as will be apparent to those skilled in the art. For example, the vessels may be located side-by-side, or one may be located above the other. Alternatively, a single vertically-partitioned vessel may be used for the same effect.

Figure 2:
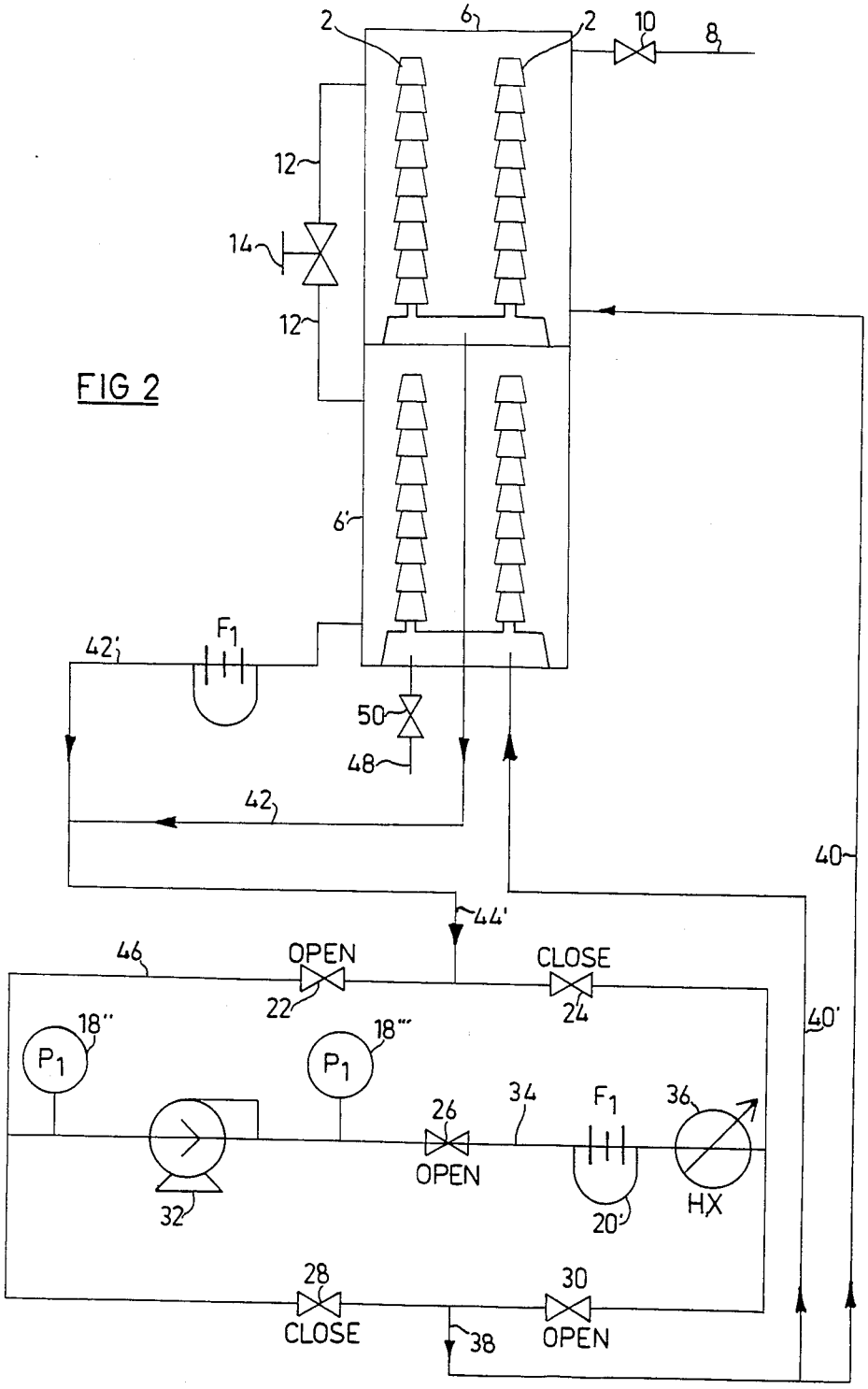
FIG. 2 illustrates an embodiment of the invention in which a single vessel divided into two portions is used in place of two separate vessels as in the embodiment of FIG. 1.

FIG. 2 illustrates a system employing a single vessel which is divided to define separate top and bottom portions. The operation of the apparatus of FIG. 2 is similar to that of FIG. 1, identical elements being labeled by identical reference numerals.

It will be appreciated that the invention is not limited to the embodiments which have been particularly shown and described, but that rather its scope will be defined by the claims which follow.

I claim:

1. Apparatus for dyeing yarn on cones comprising:

first and second dyeing enclosures, at least one carrier disposed in each of said first and second dyeing enclosures, each carrier providing liquid communication with the interior of cones of yarn disposed thereon;

means for simultaneously operating said first and second dyeing enclosures for dyeing operation including:

first means operative during a first stage of dyeing operation for causing circulation in said first dyeing enclosure of a first amount of dye liquor, which is generally little more than just sufficient to fill the carrier and the insides of the cones, in a circulation sequence from the inside of the cones therethrough to the outside; and simultaneously causing circulation in said second dyeing enclosure of a second amount of dye liquor, which is generally sufficient to fill the second dyeing enclosure at least to the top of the cones therein in a circulation sequence from the outside of the cones therethrough to the inside; and second means operative during a second stage of dyeing operation for causing circulation in said second dyeing enclosure of a first amount of dye liquor, which is generally little more than just sufficient to fill the carrier and the insides of the cones, in a circulation sequence from the inside of the cones therethrough to the outside; and simultaneously causing circulation in said first dyeing enclosure of a second amount of dye liquor, which is generally sufficient to fill the first dyeing enclosure at least to the top of the cones therein in a circulation sequence from the outside of the cones therethrough to the inside.

2. Apparatus for dyeing yarn according to claim 1 and also comprising first and second dye liquor communication ports associated with each of said first and second dyeing enclosures, said first dye liquor communication port communicating with the interior of cones of yarn via said at least one carrier and said second dye liquor communication port communicating with the exterior of said cones of yarn via the interior of the dyeing enclosure.

3. Apparatus for dyeing yarns according to claim 1 and also comprising means for repeated shifting of operation of said first and second dyeing enclosures from said first stage to said second stage.

4. Apparatus for dyeing yarns according to claim 1 and wherein said first and second dyeing enclosures are defined as parts of a single enclosure.

5. Apparatus for dyeing yarns according to claim 1 and wherein said first and second dyeing enclosures are separate.

6. A method for dyeing yarn on cones comprising the steps of:

providing first and second dyeing enclosures;

providing at least one carrier disposed in each of said first and second dyeing enclosures, for liquid communication with the interior of cones of yarn disposed thereon;

simultaneously operating said first and second dyeing enclosures for dyeing operation including:

during a first stage of dyeing operation:

causing circulation in said first dyeing enclosure of a first amount of dye liquor, which is generally little more than just sufficient to fill the carrier and the insides of the cones, in a circulation sequence from the inside of the cones therethrough to the outside; and simultaneously causing circulation in said second dyeing enclosure of a second amount of dye liquor, which is generally sufficient to fill the second dyeing enclosure at least to the top of the cones therein in a circulation sequence from the outside of the cones therethrough to the inside; and during a second stage of dyeing operation:

causing circulation in said second dyeing enclosure of a first amount of dye liquor, which is generally little more than just sufficient to fill the carrier and the insides of the cones, in a circulation sequence from the inside of the cones therethrough to the outside; and simultaneously causing circulation in said first dyeing enclosure of a second amount of dye liquor, which is generally sufficient to fill the first dyeing enclosure at least to the top of the cones therein in a circulation sequence from the outside of the cones therethrough to the inside.

7. A method for dyeing yarns according to claim 6 and also comprising the step of repeatedly shifting operation of said first and second dyeing enclosures from said first stage to said second stage.

* * * * *